United States Patent [19]

Morris

[11] 4,185,227

[45] Jan. 22, 1980

[54] CATHODE RAY TUBE WITH DUAL COLLECTOR LAYER STORAGE TARGET

[75] Inventor: Robert W. Morris, Cheney, Wash.

[73] Assignee: Tektronix, Inc., Beaverton, Oreg.

[21] Appl. No.: 822,870

[22] Filed: Aug. 8, 1977

Related U.S. Application Data

[60] Division of Ser. No. 567,941, Apr. 14, 1975, abandoned, which is a continuation of Ser. No. 502,020, Aug. 30, 1974, which is a continuation of Ser. No. 399,815, Sep. 24, 1973, which is a continuation of Ser. No. 117,710, Feb. 22, 1971, which is a division of Ser. No. 737,115, Jun. 14, 1968, Pat. No. 3,614,820.

[51] Int. Cl.[2] ..... H01J 29/50; H01J 31/00

[52] U.S. Cl. ..... 315/13 ST; 313/395; 313/397

[58] Field of Search ..... 315/13 ST, 8.5; 313/374, 392, 395, 397

[56] References Cited

U.S. PATENT DOCUMENTS

| | | | |
|---|---|---|---|
| 3,293,474 | 12/1966 | Gibson, Jr. | 313/395 |
| 3,368,093 | 2/1968 | Sjoberg et al. | 313/397 |

*Primary Examiner*—Theodore M. Blum

*Attorney, Agent, or Firm*—John D. Winkelman

[57] ABSTRACT

A storage target for a cathode ray tube is formed by adhering a layer of glass to the rear of a glass faceplate and etching depressions or apertures in such layer. Secondary emissive dielectric or phosphor material applied in these depressions will have uniform depth and therefore uniform storage properties. A storage target according to the present invention is provided with a collector on the glass layer between the apertures therein, as well as with an undercollector between the glass layer and the faceplate.

10 Claims, 7 Drawing Figures

FIG. 1
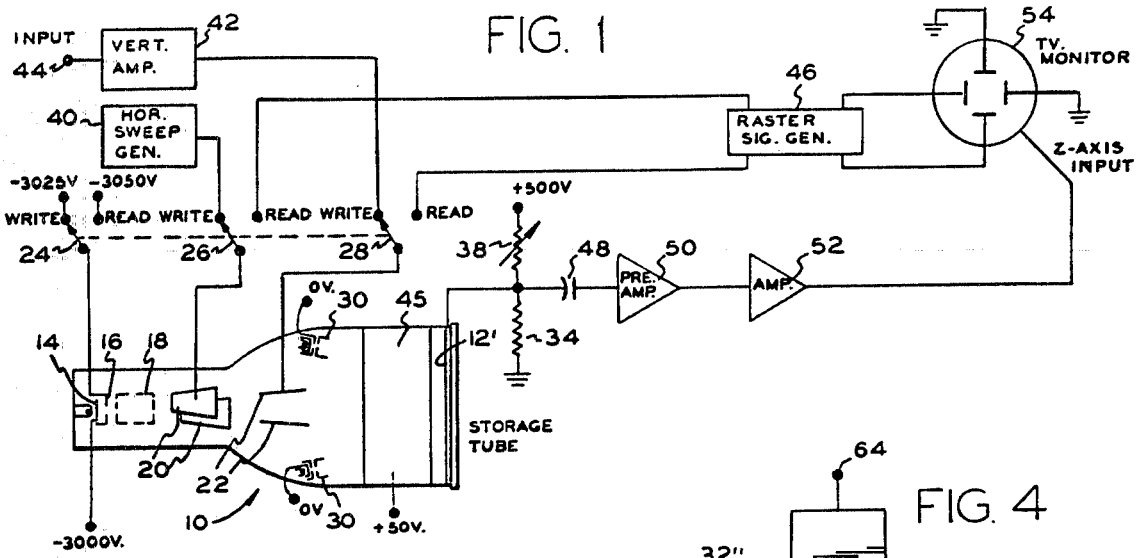
FIG. 4
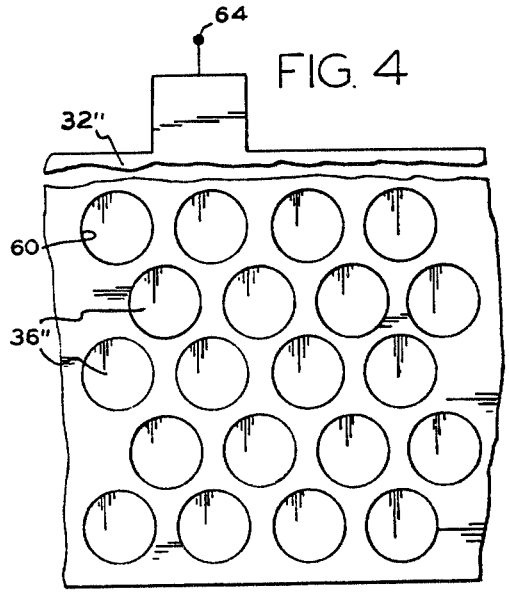
FIG. 6
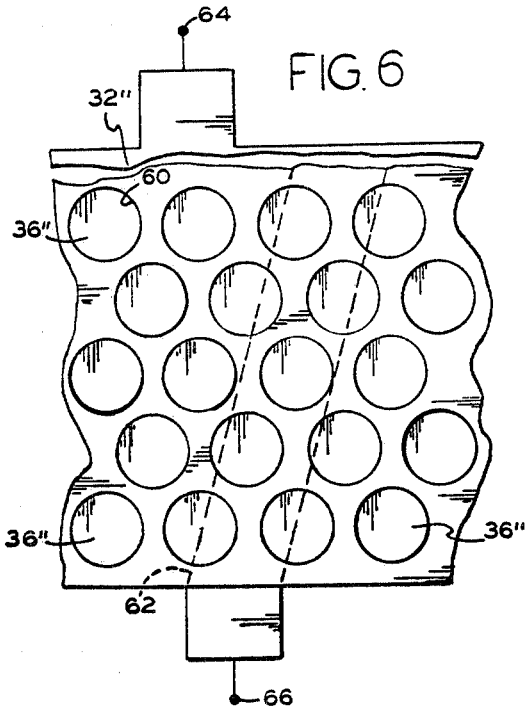
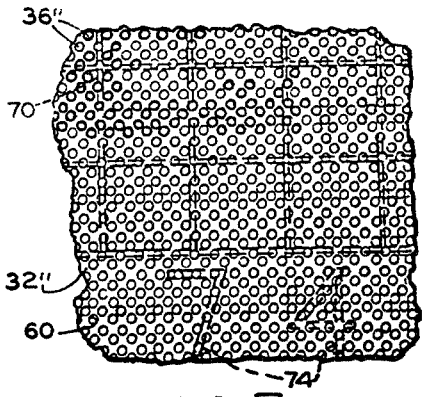
FIG. 7

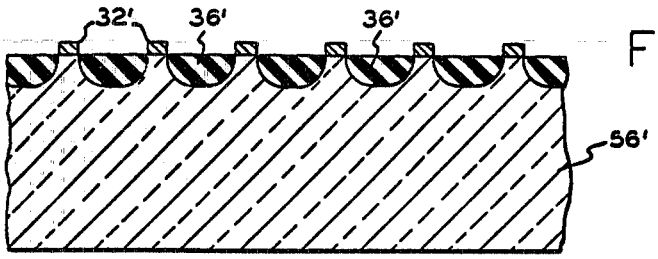
FIG. 2
FIG. 3
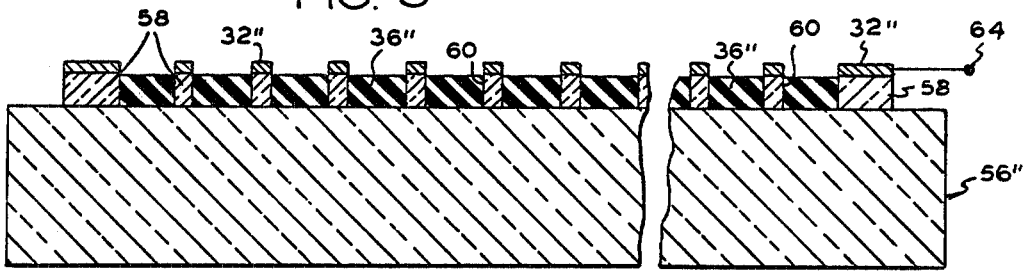
FIG. 5
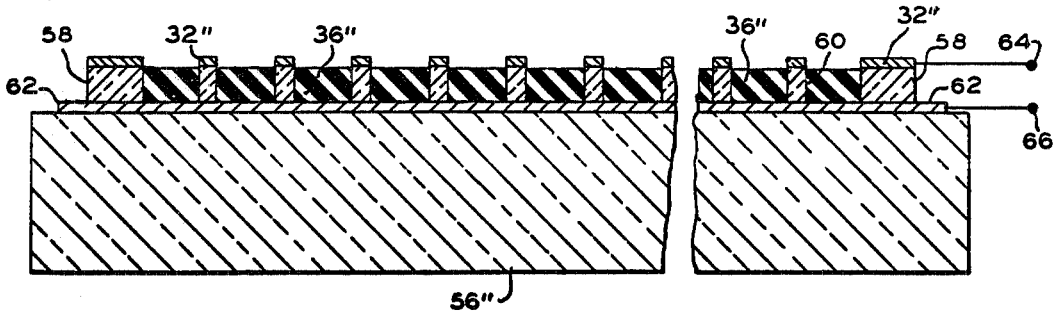

CATHODE RAY TUBE WITH DUAL COLLECTOR LAYER STORAGE TARGET

CROSS REFERENCE TO RELATED APPLICATIONS

This is a division of application Ser. No. 567,941 filed Apr. 14, 1975 and now abandoned, which was a continuation of application Ser. No. 502,020 filed Aug. 30, 1974, which was a continuation of application Ser. No. 399,815 filed Sept. 24, 1973, which was a continuation of application Ser. No. 117,710 filed Feb. 22, 1971, which was a division of application Ser. NO. 737,115 filed June 14, 1968, now U.S. Pat. No. 3,614,820.

BACKGROUND OF THE INVENTION

In Charles D. Gibson, Jr. U.S. Pat. No. 3,293,474 issued Dec. 20, 1966, entitled "Phosphor Dielectric Storage Target For a Cathode Ray Tube", and assigned to the assignee of the present invention, there is described a storage target which is simple, rugged, and reliable, and which exhibits high writing speed due to low capacitance. Storage targets of the type set forth and claimed in the Gibson patent have been employed to a considerable extent in cathode ray oscilloscopes. However, one embodiment of the target disclosed and claimed in such patent, although having the advantages of very enhanced writing speed and low field distortion, has been found difficult to manufacture in a manner achieving optimum performance characteristics possible with such a target. This target structure, illustrated at FIG. 4 in the aforementioned patent, includes a faceplate having a plurality of spaced depressions containing a dielectric secondary emissive material, e.g. a phosphor material. At the edges of the depressions containing such phosphor is located a mesh collector electrode extending toward the sources of electron emission from the level of the phosphor between elements of the mesh electrode. A straightforward method of manufacturing such a target includes the application of a photoresist to a faceplate, developing the resist, and selectively etching the depressions in the faceplate. Unfortunately, this method of manufacture of such target is difficult to control since some depressions formed thereby may be deeper than others, and because the depressions tend to be rounded on the bottom as illustrated in FIG. 2 herein. As a result, the depth of phosphor material varies across the diameter of the depression, generally being deepest at the center of the depression. Because of differing phosphor depth, the phosphor has different storage properties across each phosphor area. For example, the outer peripheries of the phosphor areas may "store" or emit light continuously at electron beam and collector voltages at which the centers of the phosphor area are able to selectively store. As a consequence of these differential properties, a higher background illumination and lower contrast image result than would be the case if the depressions and the phosphor contained therein were of uniform depth.

SUMMARY OF THE INVENTION

According to the present invention, a storage target is manufactured by adhering a layer of insulative material to a support plate, e.g. to a faceplate, wherein the layer of insulative material has the property of responding to a different etchant than would attack the support plate to any substantial degree. The insulative layer, which may also be glass, is covered with a photoresist, exposed to a desired pattern of depressions, and developed. Etchant is then applied for etching the insulative material down to the base plate to provide depressions having substantially straight sides and substantially flat bottoms. A layer of secondary emissive material is deposited in these depressions, and inasmuch as the depressions are of uniform depth, the secondary emissive material will likewise have uniform depth. The target manufactured in this manner is found to have an improved contrast ratio and other desirable properties.

A storage target according to a preferred embodiment of the present invention includes a support plate and a layer of insulating material separated by a thin electrical conductor layer. The layer of insulating material is provided with a plurality of spaced depressions having substantially straight sides extending therethrough, and a mesh collector electrode is disposed upon the layer of electrically insulating material laterally between the depressions. The thin electrical conductor layer forms an undercollector electrode and has the desirable property of further enhancing the contrast ratio of the target. Moreover, this undercollector electrode may be configured and operated to provide storage of an image corresponding to a graticule, alphanumeric character, or the like. Furthermore, the mesh collector electrode may be shaped into a desired configuration.

It is accordingly an object of the present invention to provide an improved cathode ray tube storage target exhibiting an enhanced contrast ratio.

It is a further object of the present invention to provide an improved cathode ray tube storage target which is easy to manufacture and which causes decreased electric field distortion.

It is another object of the present invention to provide an improved cathode ray tube storage target which does not have to be "faded positive" before information stored thereon is erased.

It is a further object of the present invention to provide an improved cathode ray tube storage target for a cathode ray tube wherein certain areas of the storage target may be controlled, at will, to provide presentation of a graticule, alphanumeric character, or the like.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a schematic diagram of electrical circuitry including a storage tube having a storage target made in accordance with the present invention;

FIG. 2 is a greatly magnified cross-sectional view of a storage target such as may be employed in the cathode ray tube illustrated in FIG. 1, which is manufactured according to a prior art method;

FIG. 3 is a greatly magnified cross-sectional view of a storage target manufactured in accordance with the present invention;

FIG. 4 is a greatly magnified plan view of a portion of the FIG. 3 target;

FIG. 5 is a cross-sectional view of an alternative storage target employing an undercollector electrode, also greatly magnified;

FIG. 6 is a plan view of a portion of the FIG. 5 target; and

FIG. 7 is a plan view of a portion of a target according to the present invention illustrating undercollector configurations.

DETAILED DESCRIPTION

A direct viewing, bistable storage tube 10 having a storage target 12' made in accordance with the present invention, or as disclosed and claimed in the aforementioned Gibson U.S. Pat. No. 3,293,474, is shown in FIG. 1. This storage tube may have a single electron gun including a cathode 14, a control grid 16, a focusing anode structure 18 as well as a pair of horizontal deflection plates 20 and a pair of vertical deflection plates 22. This single electron gun may be employed to produce either a writing beam or a reading beam of electrons by changing the positions of each of the three ganged switches 24, 26, and 28 connected respectively, to the control grid 16, horizontal deflection plates 20 and vertical deflection plates 22 between a "WRITE" position and the "READ" position, in a manner hereinafter described. However, it should be understood that a pair of separate electron guns may be employed to form the writing beam and the reading beam. The writing beam forms an electron charge image on the storage target 12' by deflection of the writing beam across such storage target in accordance with an input signal applied to the vertical deflection plates 22. The reading beam is employed to produce an electrical readout signal on the storage target of the storage tube by scanning the charge image stored on the storage target 12', for example, in accordance with a conventional television raster pattern.

One or more flood guns 30 may be provided within the envelope of the storage tube 10 in order to bombard the surface of the storage target 12' substantially uniformly with low velocity flood electrons in order to maintain or hold the charge image produced on such storage target by the writing beam after such writing beam no longer bombards such target. The storage target 12' includes a mesh electrode 32' on the electron beam side of the target as shown in FIG. 2 (corresponding to 32'' in FIG. 3), which is connected to a d.c. target voltage in parallel with load resistor 34. The target further includes a storage dielectric 36' (corresponding to 36'' in FIG. 3), which may comprise a phosphor, located in a plurality of spaced depressions. When the target voltage applied to mesh electrode 32' is within the "stable range" of target voltages over which the dielectric layer 36' of the storage target will store a charge image for an indefinite controllable time, the writing beam of high velocity electrons produces by secondary emission a charge image on the dielectric layer 36' which is more positive than the areas not struck by the beam. The potential of the "written" charge image is above a critical voltage corresponding to the first crossover point on the secondary emission curve of such dielectric, while the remaining "unwritten" areas of such dielectric layer have a potential below such critical voltage. The flood electrons bombarding the storage target drive the potential of the "written" areas of the dielectric layer 36' to a high voltage stable state corresponding to the potential on the mesh electrode, and drive the potential of the "unwritten" areas to a low voltage stable state corresponding to the voltage applied to the cathode of the flood guns 30. This bistable storage operation has been previously described in Anderson U.S. Pat. No. 3,293,473.

The load resistor 34 is connected to a d.c. voltage source of +500 volts through a variable bias resistor 38 whose setting controls the target voltage applied to the mesh electrode 32'. In order to erase the charge image stored on target 12' the resistance of the variable resistor 38 may be increased until the target voltage applied to the mesh electrode 32' is below the "retention threshold" voltage for the dielectric layer 36' below which the storage target will not store a charge image. Then the voltage applied to the mesh electrode is raised above the "retention threshold" voltage to a voltage within the "stable range" of target voltages over which the dielectric layer will store a charge image and the target is ready to receive another charge image.

During the writing operation of the storage tube of FIG. 1 the control grid 16 is connected by a switch 24 to a source of d.c. voltage of −3,025 volts which is slightly negative with respect to the d.c. voltage of −3,000 volts applied to cathode 14. The horizontal deflection plates 20 are connected by a switch 26 to a horizontal sweep generator 40, while the vertical deflection plates 22 are connected by a switch 28 to a vertical amplifier 42, which may be of the conventional type employed in cathode ray oscilloscopes. The input signal whose waveform is to be stored on the storage target 12, is applied to the input terminal 44 of the vertical amplifier 42.

The dielectric layer 36' of the storage target 12' may be made of phosphor material including conventional phosphors, which may be photoconductive, so that the dielectric layer produces a light image corresponding to the charge image stored thereon when the storage tube is of a direct viewing type. In this case it is not necessary to provide the storage tube with an electrical readout circuit since the waveform of the input signal can be observed directly through the faceplate of the storage tube. Photoconductive phosphors may be used as the storage dielectric because such dielectric is in the form of a plurality of separate spaced areas which may be insulated from the target electrode, as shown in FIGS. 2 and 3, to prevent the charge image stored on such dielectric from spreading due to photoconductivity. A collimating electrode 45 may be provided as a wall coating of conductive material on the interior surface of the funnel portion of the envelope adjacent the storage target 12'. This collimating electrode may be connected to a d.c. voltage of +50 volts to focus the flood electrons onto the storage target and to prevent distortion of the stored image.

However, if the dielectric layer 36' is not of phosphor, but is of another secondary emissive material, the storage tube must be provided with a readout circuit to produce an electrical readout signal corresponding to the charge image stored on the storage target. This may be accomplished by connecting the control grid 16 by switch 24 to a source of d.c. voltage of −3,050 volts in order to reduce the current density of the electron beam transmitted from the cathode 14 to target 12' in order to prevent such reading beam from producing a stored image on the target. In addition, the horizontal deflection plates 20 and the vertical deflection plates 22 may be connected by switches 26 and 28, respectively, to a raster signal generator 46. The raster signal generator applies conventional sawtooth signals of different frequency to the horizontal plates and to the vertical plates in order to produce a conventional television raster scanning pattern for the reading beam. This raster pattern can be controlled to cover all, or only a portion of the storage target 12' in order to magnify a portion of the image stored thereon. This image magnification operation can be performed automatically by adjusting the raster signal generator so that the vertical raster signal applied to the deflection plates 22 of the storage tube runs between two voltage limits which correspond to voltages on opposite sides of the waveform portion sought to be magnified. The electrical readout signal produced on the mesh electrode 32' is transmitted through a coupling capacitor 48, a low impedance preamplifier 50 and a high gain amplifier 52 to the Z-axis input of a remotely positioned television monitor tube 54 or other recording device. The horizontal and vertical deflection plates of the monitor tube 54 are also connected to the raster signal generator 46 so that the monitor tube displays the entire waveform image stored on the storage target 12' of the storage tube, or only a magnified portion of such waveform. Of course, it may be desirable to employ such a television monitor tube and electrical readout circuit even when the storage dielectric layer 36' of the target 12' is phosphor material in order to enable the remote observation of the stored waveform or to enable magnification of a portion thereof as indicated.

As hereinbefore mentioned, an advantageous target constructed in accordance with Gibson U.S. Pat. No. 3,293,474 includes a mesh electrode on the electron beam side of the target, i.e. oriented towards cathode 14 in tube 10, and including depressions in the tube's faceplate containing secondary emissive phosphor material wherein the phosphor areas are separated from one another by the elements of the mesh electrode. Such a target is illustrated in FIG. 4 of the Gibson patent. Since the mesh electrode is disposed towards the direction of electron emission both from cathode 14 and flood guns 30, a more uniform field distribution is established relative to the oncoming electrons, resulting in reduction in trace shadowing and the like. Also the writing speed of the target is enhanced. However, if the target is manufactured in accordance with ordinary methods, the depth of the depressions formed, e.g. by etching the faceplate, is difficult to control. Moreover, the depressions are frequently rounded on the bottom as illustrated in FIG. 2 wherein storage dielectric or phosphor 36' is illustrated as having nonuniform depth. As a result, the phosphor having lesser thickness near the peripheries of the depressions is apt to "write" or "store" more easily than the central portions of the phosphor. Rim lighting then frequently takes place around each phosphor area causing a reduction in the amount of available contrast or contrast ratio of the representation. That is, rim lighting in areas of the target provides a background illumination which effectively reduces the ease with which other information may be observed or detected.

According to the present invention, the storage target is made as illustrated in FIG. 3 wherein a support plate or faceplate 56'' has adhered thereto a layer of insulating material 58 provided with depressions or apertures 60 which have substantially straight sides. As illustrated in the plan view of FIG. 4, these apertures may take the form of right circular cylinders separated from one another by insulating material 58 and mesh electrode 32''. However, these apertures may take on other shapes, e.g. they may be hexagonal or square in cross section. However, it is desired that these apertures have straight side walls, and flat bottoms formed by the surface of faceplate 56''. In the case of right cylindrical apertures, the cylindrical axis is perpendicular to the surface of faceplate 56''. The phosphor or other secondary emissive material 36'' is then located in the apertures and has a substantially uniform depth starting from the surface of faceplate 56'' and extending adjacent mesh electrode 32''. Mesh electrode 32'' is disposed on the outer exposed edge of insulating material 58 and is provided with apertures matching the depressions or apertures 60 in insulating layer 58. A conductor connects mesh electrode 32'' to a terminal 64, e.g. for connection between resistors 34 and 38 in FIG. 1. The upper surface of the phosphor or secondary emissive material (in FIG. 3) is desirably flat and lower than the lower surface of mesh electrode 32'' so that the phosphor or secondary emissive material does not contact the mesh electrode at any point around its periphery.

In the usual instance, support plate or faceplate 56'' will be formed of glass, and the layer of insulating material 58 will also be of glass material, although it is understood that other insulating materials may be used for these applications. The layer of insulating material 58 should have the property of responding to a different etchant than would etch or attack support plate or faceplate 56'' to any substantial degree, so that in manufacture of the target, material 58 may be etched without the etching of faceplate 56''.

The secondary emissive material or phosphor 36'' in the construction according to FIGS. 3 and 4 is of uniform depth and therefore has uniform storage properties. That is, any part of the phosphor will store under substantially the same conditions and tube potentials. Therefore, background storage or lighting is avoided and contrast is thereby enhanced. Also, since the secondary emissive material or phosphor does not touch mesh electrode 32'', edge lighting of the phosphor or edge storage of the secondary emissive material due to actual contact with the mesh electrode is avoided. Moreover, as a result of further decreased field distortion, it has not been found necessary to pulse the target mesh electrode positive before erasing the target.

According to the method of the present invention, the target illustrated in FIGS. 3 and 4 is manufactured as follows:

The support plate or faceplate 56'' is suitably formed of glass, e.g. standard window glass or soda-lime glass. One specific example of a glass that has been used is Libby Owens Ford "Parallel-O-Plate", and another is Corning 0122 glass. A continuous layer of insulating material 58 (without depressions) is adhered to faceplate 56''. As hereinbefore mentioned, insulating material 58 should have the property of responding to a different etchant than would each support plate or faceplate 56'', and material 58 should also melt at a lower temperature than faceplate 56''. A suitable material 58 is a glaze or glass frit applied as a slip or slurry, mixed with water, upon faceplate 56''. Application of the slip may be by casting it directly onto the faceplate, spraying it onto the faceplate, or casting it on another surface and then transferring it to the faceplate. The slip may be deposited to a uniform depth between approximately ten and thirty microns. In some cases a plastic binder may be used which is later fired out.

A suitable glaze is lead borosilicate glass mixed with a flux. Among examples of various materials which may be used are Harshaw Q-12 glaze, Harshaw No. 83 frit, Corning No. 89 frit, and Corning No. 95 frit. The faceplate is suitably fired in a kiln to fuse the insulating material 58 and adhere the same to the faceplate or, alternatively, an exposed heating element may be positioned adjacent only the insulating layer on the faceplate. Of course, the firing is at a temperature such that the insulating material 58 is fired without melting or materially affecting the faceplate. Then, a layer of metal is evaporated onto insulating material 58 forming the basis of mesh electrode 32″. This metal may be any suitable conductor which can be evaporated and which will not poison the cathode ray tube cathode or the phosphor or the like in the tube. Gold is a suitable metal.

In applying the metal layer, the faceplate with the insulating layer adhered thereto is first thoroughly cleaned. In a particular example the faceplate with a glass insulating layer was placed after cleaning, in an evaporation chamber which was evacuated to $10^{-5}$ Torr. A layer of nickel was evaporated onto the insulating layer to a depth of approximately 100 Angstroms, after which a layer of gold was evaporated to a depth of approximately 1000 Angstroms. The nickel was used to adhere the gold to the glass insulating layer.

A layer of commercially available photoresist is applied over the aforementioned metal, e.g. gold, layer and the photoresist is exposed to a contact pattern having the desired configuration of mesh electrode 32″. Such pattern will thus have the appearance of the pattern of apertures illustrated in FIG. 4. The photoresist is then developed for leaving a protective coating of photoresist on top of the metal layer. Then, an etchant is applied which will etch the metal from which mesh electrode 32″ is formed. For example, in the case of gold, a standard cyanide gold etching solution is appropriate. Then an etchant is applied which will etch insulating material 58 but which will not etch the faceplate 56″. In the case of glass frit or glaze material mentioned above, dilute hydrochloric acid, or acetic acid in combination with hydrogen peroxide is suitable. A weak acid is preferred and nearly any acid may be used except hydrogen fluoride which would affect faceplate 56″. During the etching of insulating material 58, it will be observed that the gold or other metal forming mesh electrode 32″ provides an etching mask, along with the photoresist thereover.

A number of dielectric secondary emissive materials can be provided in aperture 60, but phosphor is employed in the case of a direct viewing storage tube. Many different phosphors are suitable, and a wider range of phosphors may be employed with the target made according to the present invention than was possible with prior constructions. Among the phosphors which may be disposed at 36″ in the apertures 60 are included both silicate and sulphide phosphors such as P1, P4, P11, P18, P20, and P31. The phosphor P31 has been found especially useful, and with the construction according to the present invention, the contrast ratio obtainable therewith is greatly improved rendering this phosphor advantageously usable in storage tubes. P31 and sulphide phosphors in general have the property of extremely long life under actual operating conditions as compared with silicate phosphors. Also, improved optical writing is obtained with sulphide phosphors as when an image to be stored is presented optically upon storage target through faceplate 56″, e.g. as by focusing a light image upon the target. Also, various photoemissive substances can be added to the phosphor used with the target according to the present invention.

A phosphor is suitably deposited in apertures 60 by a settling method wherein the phosphor can be deposited to a desired depth, e.g. just under the lower surface of mesh electrode 32″. According to this method the phosphor is carried in a liquid and is settled into apertures 60 in a manner whereby the phosphor deposits levelly within apertures 60 without depositing upon mesh electrode 32″. The phosphor particles appear to taken on a charge such that this differential deposition is possible. Application of the phosphor in this manner is further described and claimed in U.S. Pat. No. 3,585,074 to Margaret J. Jones.

In the embodiment illustrated in FIG. 4, the apertures 60 were approximately three to four mils in diameter, and were spaced four to five mils apart, e.g. leaving one-half to one mil between apertures. Of course, the apertures may be further spaced if so desired, but it is advantageous to image clarity that the apertures be as closely spaced as possible. The layer 58 was ten to thirty microns in thickness.

A target according to the best mode presently contemplated for carrying out the invention is illustrated in FIGS. 5 and 6 wherein the same reference numerals are employed for similar elements illustrated in FIGS. 3 and 4. This target is manufactured in the same manner, except that before layer of insulating material 58 is applied, a thin conductive layer 62 is first applied. The latter conducting layer is suitably tin oxide and is deposited upon the support plate or faceplate 56″ in any convenient manner, e.g. by reactive spraying. E.G. the faceplate is first cleaned thoroughly and heated in an oven to a temperature of approximately 565° C. The faceplate is then sprayed with a methanol solution contaning stannic chloride. The faceplate is allowed to cool and the tin oxide formed is checked for conductivity which should be 100 to 1000 ohms per square. The surface is then suitably cleaned before application of a frit or glaze which will form an insulating layer.

The tin oxide conductive layer 62 is on the order of microns or less in thickness so as to be substantially transparent in the preferred embodiment. The conductive layer 62 forms an undercollector which cooperates with the collector provided by mesh electrode 32″. A conductor connects layer 62 to a terminal 66 for connection to an appropriate source of voltage. In one embodiment of the storage electrode of FIGS. 5 and 6, layer 62 is uniformly disposed under the phosphor or secondary emissive material 36″ and under insulating material 58. In operation of this embodiment in tube 10, mesh collector electrode 32″ is adjusted to a first potential, say from +150 to +200 volts to provide storage operation. The layer 62 comprising the undercollector is adjusted to a voltage from approximately 25 volts to 75 volts more negative than the voltage level of the mesh collector electrode. Storage operation with the undercollector employed in this manner is found to further enhance the contrast ratio of the storage target according to the present invention. It is postulated that the reason for such improved contrast ratio is that the relatively negative field of layer 62 extends up through secondary emissive or phosphor layer 36″ retaining the phosphor material in a given aperture 60 in a non-stored condition until it is actually "written" by the tube's electron beam. The voltages on layer 62 described above are given merely by way of example, and the voltage thereon should be adjusted in a given tube until the enhanced contrast is produced. If the voltage on layer 62 becomes too positive, the phosphor or secondary emissive material will "store" continuously, and if the voltage or layer 62 is too negative, the phosphor or secondary emissive material will not store at all. The undercollector formed by layer 62 may be employed to erase theretofore stored information on the storage target by lowering the voltage on layer 62. The use of layer 62 further enables the use of sulphide type phosphors as a secondary emissive storage medium because of the further improved contrast ratio achieved with layer 62.

According to another feature of the present invention, conductive layer 62 may be configured in the shape of an alphanumeric character or graticule or some other configuration and controlled independently of other stored information on the target. For example, the layer 62 may comprise a narrow strip of conductor as illustrated in FIG. 6. If the layer 62 is adjusted in potential to a level somewhat more positive than mesh collector electrode 32'', the phosphor immediately above layer 62 will store continuously, or be illuminated continuously. While a graticule is a most useful pattern, obviously, the configuration of layer 62 may take any form or characterization which it is desired to control independently, such as an alphanumeric character.

FIG. 7 further illustrates configured undercollectors employed in a target, here depicted at lower magnification. A first undercollector 70 is configured to provide a graticule, while second undercollectors 74 take the form of a pair of alphanumeric characters. The mesh electrode 32'' can also be configured, if desired. For example, the latter may be divided and connected to separate sources of voltages so that different portions of the target can be separately controlled for selective storage in different areas. In FIG. 5, for instance, the mesh electrode 32'' as illustrated on the left side of the drawing may be insulated from and separately connected from the mesh electrode illustrated on the right side of the drawing, for providing separate storage and erasing properties.

While I have shown and described preferred embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. Electron image storage apparatus comprising a cathode ray tube having a target and means including a cathode for producing an electron beam directed toward said target, which target includes an electrically conductive layer forming a first collector electrode, a layer of electrically insulative material disposed overlying said conductive layer, said insulative layer having a plurality of apertures at spaced-apart locations therein, a second, mesh collector electrode of conductive material disposed on the side of said insulative layer remote from said conductive layer, said second collector electrode being substantially insulated from said first collector electrode, a layer of substantially dielectric secondary emissive material contained in said apertures with areas of said secondary emissive material separated from each other by said insulative material, said apparatus additionally comprising means for applying to said second collector electrode a voltage that is positive relative to said cathode, and means for applying to said first collector electrode a voltage that is negative relative to the voltage applied to said second collector electrode.

2. The apparatus of claim 1, wherein said secondary emissive material comprises a phosphor.

3. The apparatus of claim 1, wherein said second collector electrode includes a plurality of apertures that are substantially in registration with the apertures of said layer of insulative material.

4. The apparatus of claim 1, wherein the apertures in said layer of insulating material have a circular cross section.

5. The apparatus of claim 1, wherein said second collector electrode is spaced from the top surface of said layer of secondary emissive material.

6. Electron image storage apparatus comprising a cathode ray tube having a storage target and means including a cathode for producing an electron beam directed toward said target, which target includes a support plate of electrically insulative material, a thin, electrically conductive layer disposed on one side of said plate covering a predetermined area of said side and forming a first collector electrode, an apertured layer of electrically insulative material disposed on said conductive layer, a second, mesh collector electrode of an electrically conductive material adhered to the side of said apertured layer that is remote from said plate with the apertures of said mesh collector in substantial registration with those of said apertured layer, said second electrode being substantially insulated from said first collector electrode, a discontinuous layer of substantially dielectric secondary emissive material contained in the apertures of said layer of insulative material, with areas of said secondary emissive material being separated from each other by said insulative material and by said mesh collector electrode, the top surface of said secondary emissive material areas being adjacent said mesh electrode and fully exposed to said electron beam, said apparatus additionally comprising means for applying to said second collector electrode a voltage that is positive relative to said cathode, and means for applying to said first collector electrode a voltage that is negative relative to the voltage applied to said second collector electrode.

7. The apparatus of claim 6, wherein the apertures in said apertured layer are circular in cross section, forming substantially cylindrical depressions in said layer that are substantially perpendicular to said support plate.

8. The apparatus of claim 6, wherein said support plate and apertured layer are both glass, and wherein said electrically conductive layer is tin oxide.

9. The apparatus of claim 6, wherein said secondary emissive material comprises a phosphor, and wherein said electrically conductive layer is substantially transparent.

10. The apparatus of claim 6, wherein the voltage applied to said first collector electrode is in the range of about 25 to about 75 volts more negative than the voltage applied to said second collector electrode.

* * * * *